US006296024B1

(12) United States Patent
Oestreich

(10) Patent No.: US 6,296,024 B1
(45) Date of Patent: Oct. 2, 2001

(54) APPARATUS AND METHOD FOR RECOVERING VISCOUS FLUID

(75) Inventor: Michael A. Oestreich, Pine Springs, MN (US)

(73) Assignee: Michael Oestreich, Forest Lake, MN (US)

( * ) Notice: Subject to any disclaimer, the term of this patent is extended or adjusted under 35 U.S.C. 154(b) by 0 days.

(21) Appl. No.: 09/679,662

(22) Filed: Oct. 4, 2000

Related U.S. Application Data

(63) Continuation of application No. 09/243,058, filed on Feb. 2, 1999, now abandoned.
(60) Provisional application No. 60/073,338, filed on Feb. 2, 1998.

(51) Int. Cl.[7] ..... B65B 39/00
(52) U.S. Cl. ..... 141/1; 141/364; 141/375
(58) Field of Search ..... 141/364, 375

(56) References Cited

U.S. PATENT DOCUMENTS 3,266,533 * 8/1966 McHale ..... 141/364
3,615,150 * 10/1971 Indrunas ..... 141/375
3,877,499 * 4/1975 Fluster ..... 141/346
3,945,617 * 3/1976 Callery ..... 141/364
4,057,940 * 11/1977 Wemmer ..... 51/438
4,313,477 * 2/1982 Sebalos ..... 141/364
4,347,879 * 9/1982 Blaser ..... 141/364
5,421,371 * 6/1995 Lauer ..... 138/110
5,642,763 * 7/1997 Kurtz ..... 141/375
5,884,678 * 3/1999 Chudy ..... 141/364
5,918,650 * 7/1999 Borden ..... 141/364
5,950,698 * 9/1999 Cristea et al. ..... 141/364

* cited by examiner

*Primary Examiner*—J. Casimer Jacyna
(74) *Attorney, Agent, or Firm*—Skinner and Associates

(57) ABSTRACT

A fluid recovery sleeve, comprising a wall having an inner wall surface forming a fluid communication passage, a top surface having an opening for receiving a salvage container to be drained, and a bottom surface having an opening for receiving a recovery container to catch fluid drained form the salvage container. The bottom and top surfaces are formed from the wall. The openings provide an entrance and an exit for the fluid communication passage. The bottom opening of the sleeve is placed over the neck of a recovery container. The salvage container is inverted and its neck is placed in the top opening of the sleeve. Remaining or leftover fluid drains from the salvage container, through the fluid communication passage of the sleeve, and into the recovery container. The sleeve is preferably constructed of an elastic material to provide a seal around the necks of the containers and to support the inverted salvage container above the recovery container.

3 Claims, 5 Drawing Sheets

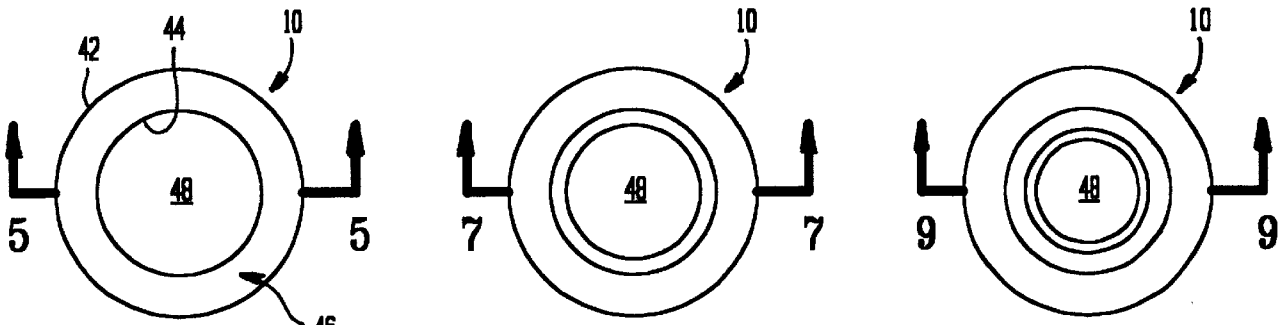
FIG. 4
FIG. 6
FIG. 8
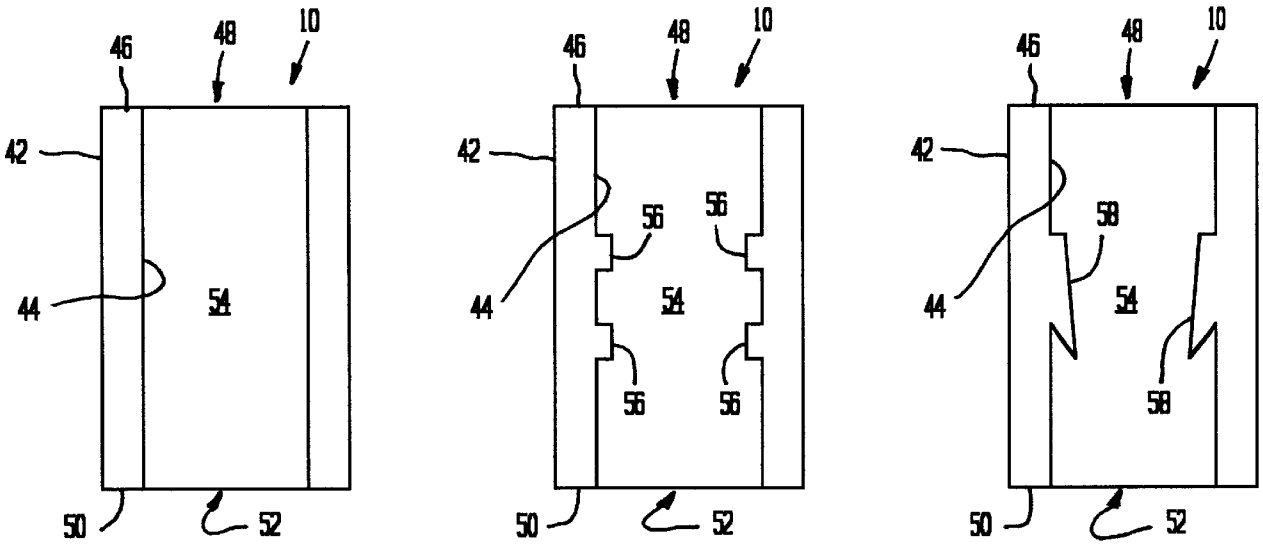
FIG. 5
FIG. 7
FIG. 9

APPARATUS AND METHOD FOR RECOVERING VISCOUS FLUID

CROSS-REFERENCE TO RELATED APPLICATIONS, IF ANY

This application is a continuation of application Ser. No. 09/243,058, filed Feb. 2, 1999, now abandoned, which claims the benefit under 35 U.S.C. §119(e) of co-pending provisional application Ser. No. 60,073,338, filed Feb. 2, 1998, both of which are hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to fluid transfer apparatus and methods. More particularly, the invention relates to apparatus and methods for recovering or salvaging viscous fluids from bottles or containers. The invention has particular utility in recovering viscous fluids from used, nearly-empty, and nearly unusable bottles into a usable bottle.

2. Background Information

Known methods for recovering and/or using viscous fluids from a bottle or container includes inverting the bottle to drain the viscous fluid out through the neck of the bottle, and further includes cutting the bottle or other container open and scraping the viscous fluid from the inside walls.

The known devices and methods for recovering viscous fluids are believed to have significant limitations and shortcomings. Specifically, it is difficult to balance some types of bottles on their neck because of their size, shape or environment. In addition, cutting a container open to scrape out the remaining or leftover fluid is messy and dangerous because of the risk of cutting oneself with a knife. Furthermore, it may not be possible to dispense the viscous fluid from the bottle when there is a low volume of the fluid, regardless of whether the viscous fluid has settled into the neck of the bottle.

Applicant's invention provides an apparatus and method for recovering viscous fluids which is believed to constitute an improvement over existing technology.

BRIEF SUMMARY OF THE INVENTION

The present invention provides an apparatus and method for recovering viscous fluid from a container. The apparatus generally comprises a cylindrically-shaped or tubular sleeve with an open top and an open bottom. The sleeve has an inner diameter shaped to conform to the outer surface of a container neck to form a seal with the container. The sleeve is preferably constructed from an elastic material that forms a seal with the bottle by expanding around and snugly retracting around the neck of a bottle. In a preferred embodiment, the sleeve is constructed from foam rubber. The foam rubber construction also provides the sleeve with the rigidity and strength to support and balance a bottle by its neck. Additionally, the present invention provides a method for recovering viscous fluid which generally comprises the steps of gathering a salvage container for a specific fluid and a recovery container for the same fluid; inserting the bottom end of the viscous fluid recovery sleeve around the neck and neck opening of the recovery member, and inverting and placing the neck opening of the salvage container into the top end of the recovery sleeve. The recovery sleeve provides fluid communication between the neck opening of the salvage container and the neck opening of the fluid recovery container, and supports the salvage container in an inverted position over the recovery container. Gravity controls the flow of the viscous fluid from the salvage container to the recovery container.

Significant features of the invention include both the shape and the elasticity of the device, the ease of manufacture, and the ease of use to recover viscous liquid from a salvage container to a recovery container. Additionally, the present invention provides significant savings by using a low cost means for recovering and using product that normally would cling to and be disposed with the container.

The features, benefits and objects of this invention will become clear to those skilled in the art by reference to the following description, claims, if any, and drawings.

BRIEF DESCRIPTION OF THE SEVERAL VIEWS OF THE DRAWING

FIG. 4 is a top view of a preferred embodiment of the present invention.

FIG. 5 is a cross sectional view taken along line 5—5 of FIG. 4.

FIG. 6 is a top view of an alternative embodiment of the present invention.

FIG. 7 is a cross sectional view taken along line 7—7 of FIG. 6.

FIG. 8 is a top view of another alternative embodiment of the present invention.

FIG. 9 is a cross sectional view taken along line 9—9 of FIG. 8.

DETAILED DESCRIPTION

Figure 3:
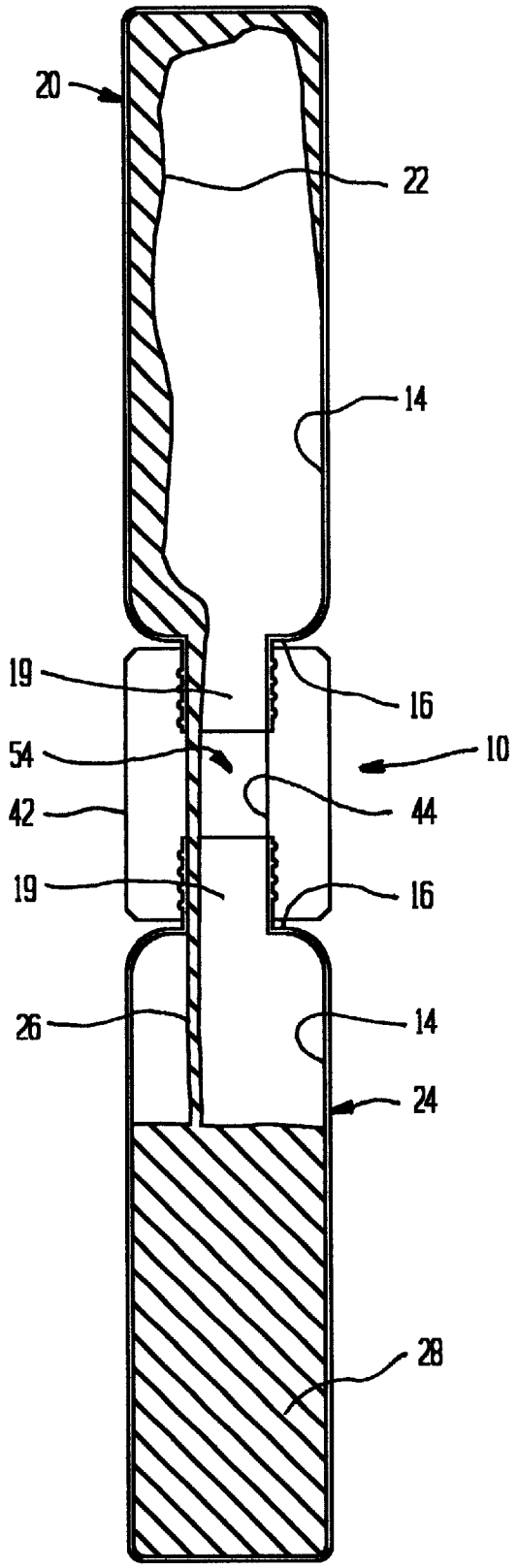
FIG. 3 is a cross sectional view of the method of the present invention showing viscous fluid draining from a salvage container, through the device of the present invention, and into a recovery container.
Figure 10:
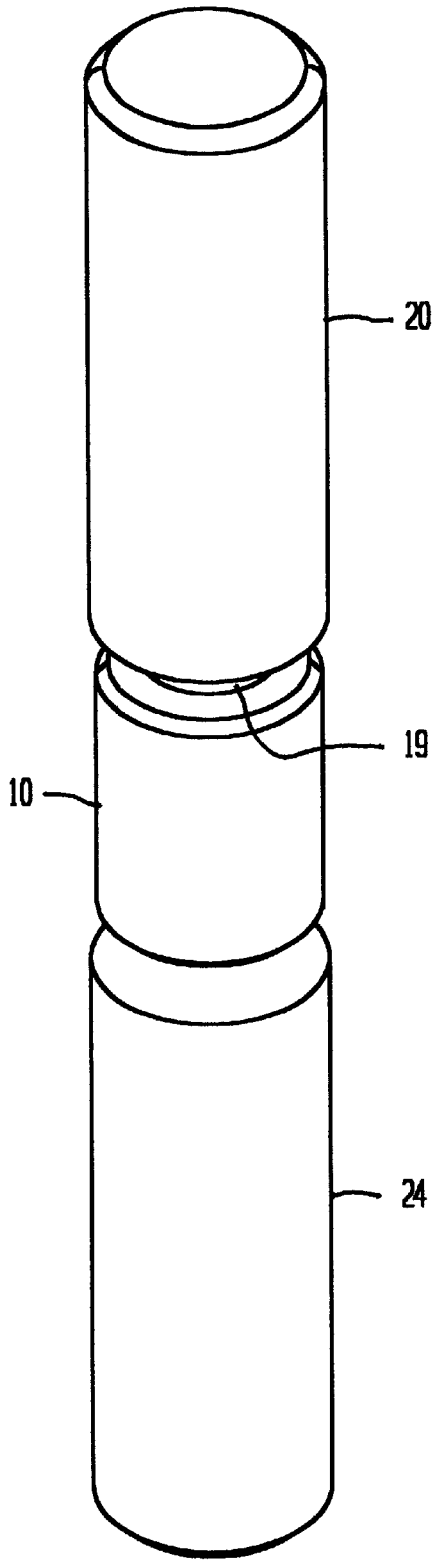
FIG. 10 is a photograph showing the method and apparatus of the present invention used with shampoo bottles.
Figure 11:
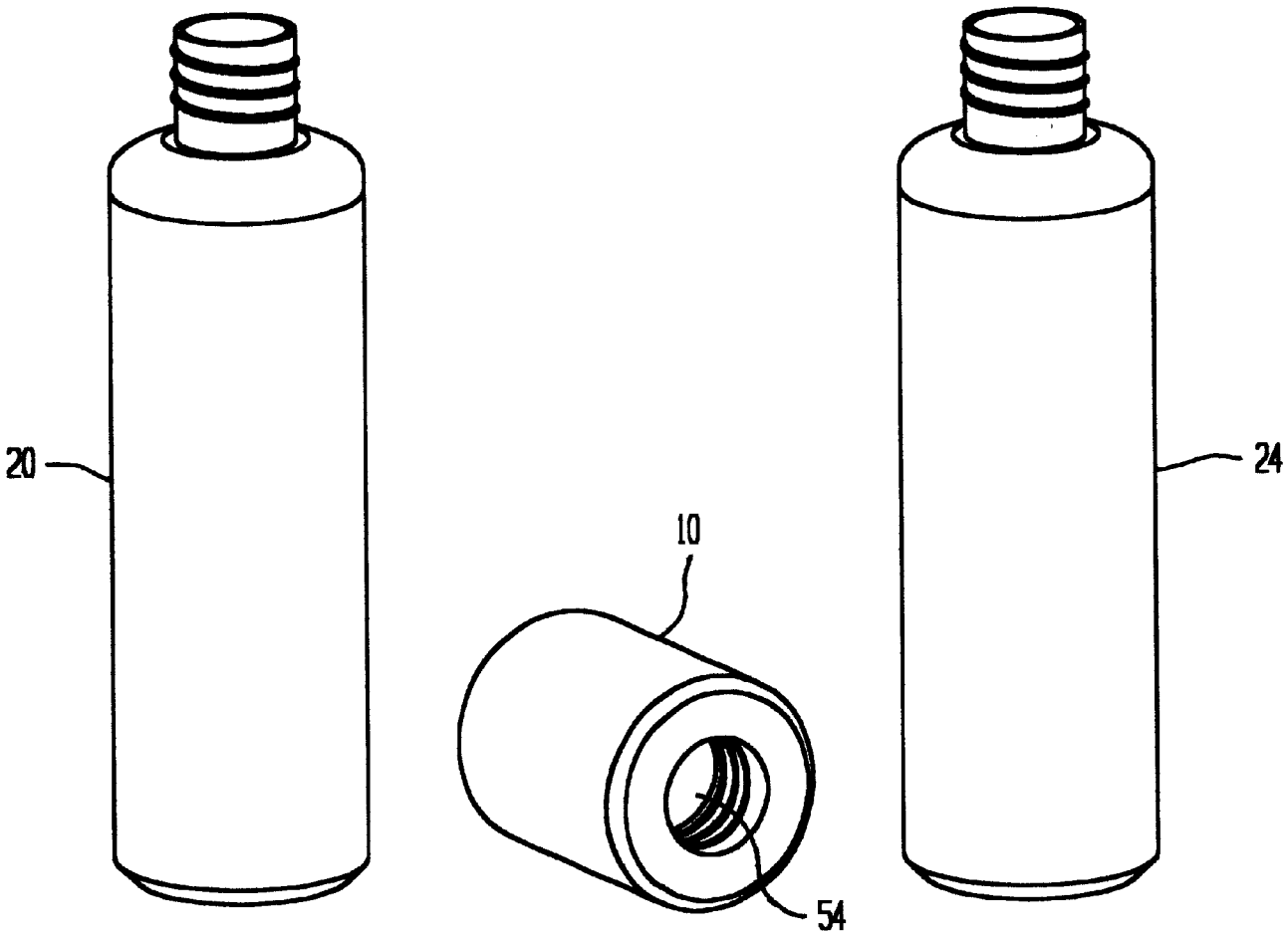
FIG. 11 is a photograph showing a salvage and a recovery shampoo bottle, and the apparatus of the present invention.

Referring to FIGS. 3–5, an example of the preferred embodiment of the present invention is illustrated and generally indicated by the reference numeral 10. The need to recover viscous products from containers is discussed below first. The viscous fluid recovering sleeve 10 is then described below first in terms of its elements which cooperate to recover viscous fluids from a bottle or container. Finally, the method of using the sleeve 10 to recover viscous fluids is described.

Figure 1:
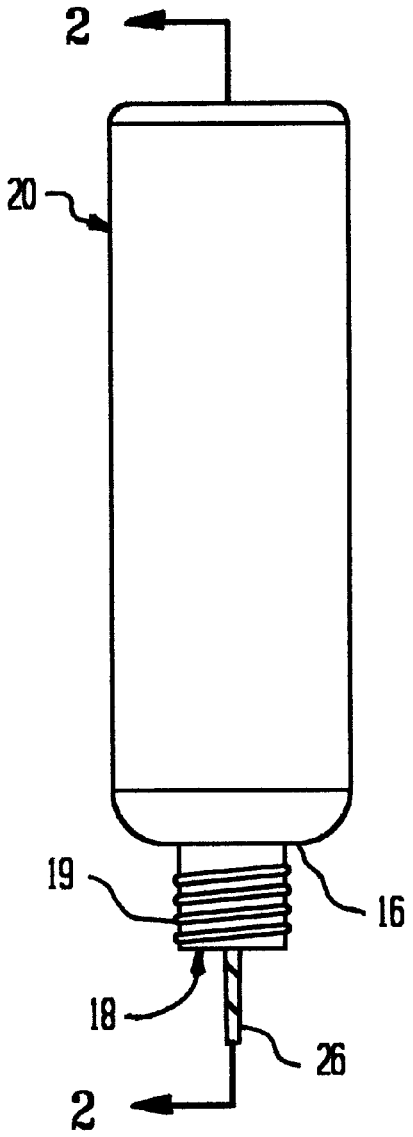
FIG. 1 is a side view of an inverted bottle draining viscous liquid.
Figure 2:
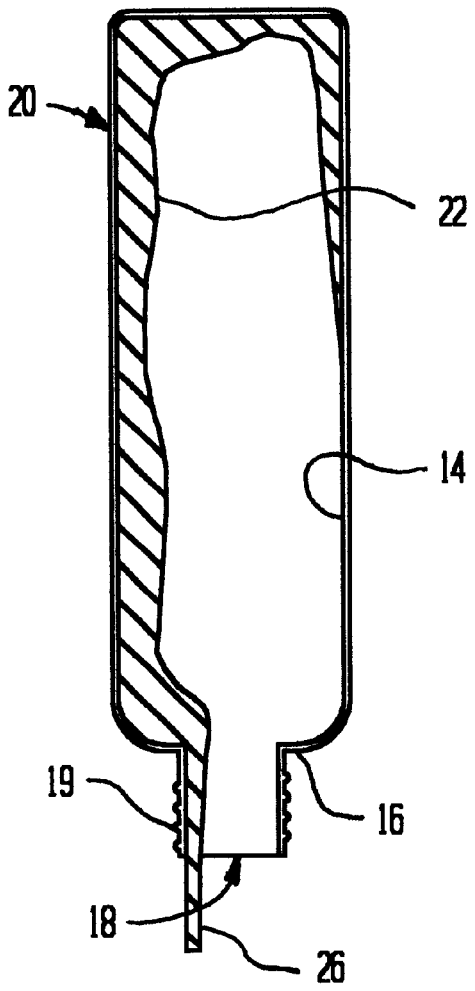
FIG. 2 is a cross sectional view taken along line 2—2 of FIG. 1.

There are various products that have the characteristics of a viscous fluid. These products include shampoo, conditioner, ketchup, mustard, salad dressing, honey, detergent, cosmetics, cocktail sauce, syrup and oil. As illustrated in FIGS. 1 and 2, a recurring problem with these viscous products is that a substantial amount of leftover or remaining fluid 12, often amounting to several usable doses or servings, clings to the interior walls 14 and shoulder 16 of the container. Typically, a large portion of the remaining fluid 12 will eventually drain out through the neck opening 18 of an inverted container over a considerable amount of time. It is desirable that this portion of the remaining fluid be salvaged and used; however it is typically disposed with the near empty container because of the difficult, time-consuming, and/or messy task of salvaging the fluid.

FIG. 3 generally illustrates the method of recovering viscous fluid of the present invention. A salvage bottle 20 containing leftover or remaining viscous fluid 22 desired to be salvaged is inverted over a recovery bottle 24. The draining viscous fluid 26 drips out of the salvage bottle 20, through a viscous fluid recovery sleeve 10, and into a pool of recovered viscous fluid 28 in the recovery bottle 24. The sleeve stabilizes and supports the salvage bottle 20 over the recovery bottle 24. The neck opening 18 of the salvage bottle 20 is placed in fluid communication with the neck opening 18 of the recovery bottle 24 because of a channel or fluid communication passage 54 within the viscous fluid recovery sleeve 10. Gravity forces the draining viscous fluid 26 from the salvage bottle 20, through the sleeve, and into the recovery bottle 24.

The viscous fluid recovery sleeve 10 is suitable for use both as a means for stabilizing and supporting the salvage bottle 20 over the recovery bottle 24, and as a means for providing fluid communication between the neck opening 18 of the salvage bottle 20 and the neck opening 18 of the recovery bottle 24. The viscous fluid recovery sleeve 10 has a cylindrical or tubular shape with an outer wall surface 42 and an inner wall surface 44, and further has a top surface 46 with a top opening 48 and a bottom surface 50 with bottom opening 52. A fluid communication passage 54 is formed by the inner wall surface 44 and between the top and bottom openings 50 and 52.

The method of the present invention uses the viscous fluid recovering sleeve 10 in the following steps. The bottom opening 52 is inserted over the neck 19 of the recovery bottle 24 so that the bottom surface 50 of the sleeve 10 rests on the shoulder 16 of the recovery bottle 24. Likewise, the neck 19 of the salvage bottle 20 from which remaining viscous fluid 22 is to be drained is inserted into the top opening 48 so that the shoulder 16 of the salvage bottle 20 rests on the top surface 46 of the sleeve 10. Alternatively, top opening 48 of the sleeve 10 could be inserted over the neck 19 of the salvage bottle 20 first, and then the bottom opening 52 of the sleeve 10 could be inserted over the neck 19 of the recovery bottle 24 as the salvage bottle 20 is inverted and positioned over the recovery bottle 24. The method of the present invention is not limited to performing the steps in a particular order.

The sleeve 10 is preferably created from a resilient, elastic material such as foam rubber, which causes the top and bottom openings 48 and 52 to seal around the necks 19 of the bottles 20 and 24. Furthermore, the resiliency of the material allows the sleeve 10 to support the inverted salvage bottle 20 over the recovery bottle 24. The draining viscous fluid 26 flows from the salvage bottle 20 down the inner wall 44 of the sleeve 10 and into the recovery bottle 24.

FIGS. 4 and 5 show a preferred embodiment of the viscous fluid recovery sleeve 10 of the present invention. It has smooth, concentric inner and outer walls 44 and 42. This embodiment is inexpensive and efficient to manufacture in long segments of extruded foam rubber. Pipe insulation, for example, is constructed in such a manner. Pipe insulation is and has been manufactured and sold by a variety of providers, including for example ARMAFLEX insulation by Armstrong World Industries of Lancaster, Pa., USA. Pipe insulation is typically sold in lengths between 4 and 8 feet, with wall thicknesses of ½ inch, and internal passages of one half to 1⅜ inches in diameter. The long segments are then cut to the desired length. FIGS. 6 and 7 show an alternative embodiment of the sleeve 10 in which the inner wall surface 44 has ribs 56 or projections. These ribs 56 help form a tight seal between the necks 19 of both bottles 20 and 24 to prevent fluid from dripping down the side of the neck 19 and shoulder 16 of the recovery bottle 24. Furthermore, these ribs 56 are preferably annularly shaped. FIGS. 8 and 9 show another alternative embodiment of the sleeve 10 in which the inner wall surface 44 has an inwardly projecting slope 58. The slope 58 helps form a tight seal between the necks 19 and also forms a funnel shape to help direct the draining viscous fluid 26 into the neck opening 18 of the recovery bottle 24. It is anticipated that numerous inner wall configurations, depending on the shape of the container and container neck, could be designed to assist with supporting the salvage bottle 20, forming a seal between the salvage bottle 20 and recovery bottle 24, and directing the draining viscous fluid 26 from the salvage bottle 20 to the recovery bottle 24. It is also anticipated that the inner wall 44 could be configured with inner threads corresponding to exterior threads on a container neck. Additionally, although the preferred embodiments show a generally cylindrically-shaped sleeve 10, it is anticipated that the sleeve 10 could be adapted for a variety of container shapes within the teachings of this invention.

Although the term bottle has been used within this application, the method and apparatus of this present invention could be used with other containers. Furthermore, although the term viscous fluid has been used within this application, the method and apparatus of this present invention could be used with a large variety of products and with any type of fluid or with granular type articles such as sand, gravel, and dirt.

The elasticity of the foam rubber allows the viscous fluid recovery sleeve to stretch and seal around a range of various-sized container necks. However, the elasticity of the foam rubber is limited. Therefore, the foam rubber sleeves are preferably distributed as a set having various-sized diameters designed to fit around common container necks.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A method of recovering fluid from a salvage container to a recovery container, comprising the steps of:

(a) providing a predetermined initial length of foam rubber having a wall having an inner wall surface forming a passage;

(b) cutting said initial length of foam rubber to form at least one fluid recovery device, comprising:

(i) a wall of a predetermined length, said wall forming a tubular sleeve with both a cylindrical inner wall surface and a cylindrical outer wall surface extending the entire length of said wall, said inner wall surface forming a fluid communication passage, said cylindrical outer wall surface being concentric with respect to said cylindrical inner wall surface;

(ii) said tubular sleeve having a top surface with an opening for receiving a salvage container, said top surface opening providing an entrance to said fluid communication passage, said wall having an elastic quality to form a seal with said salvage container, said wall having sufficient resiliency to support said salvage container in an inverted position; and (ii) said tubular sleeve having a bottom surface with an opening for receiving a recovery container, said bottom surface opening providing an exit from said fluid communication passage, said elastic quality of said wall forming a seal with said recovery container, and (c) placing the opening of the bottom end of the device over the neck of the recovery container;

(d) inverting the salvage container; and (e) inserting the neck of the salvage container into the opening of the top surface of the device, wherein fluid drains from the neck opening of the salvage container into the neck opening of the recovery container.

2. The method of claim 1, wherein the initial length of foam rubber is pipe insulation.

3. A method of using foam pipe insulation to recover fluid from a salvage container to a recovery container, comprising the steps of:

(a) providing a predetermined initial length of foam rubber pipe insulation having a wall having an inner wall surface forming a passage;

(b) cutting said initial length of foam rubber to form at least one fluid recovery device, comprising:

(i) a wall of a predetermined length, said wall forming a tubular sleeve with both a cylindrical inner wall surface and a cylindrical outer wall surface extending the entire length of said wall, said inner wall surface forming a fluid communication passage, said cylindrical outer wall surface being concentric with respect to said cylindrical inner wall surface;

(ii) said tubular sleeve having a top surface with an opening for receiving a salvage container, said top surface opening providing an entrance to said fluid communication passage, said wall having an elastic quality to form a seal with said salvage container, said wall having sufficient resiliency to support said salvage container in an inverted position; and (ii) said tubular sleeve having a bottom surface with an opening for receiving a recovery container, said bottom surface opening providing an exit from said fluid communication passage, said elastic quality of said wall forming a seal with said recovery container, and (c) placing the opening of the bottom end of the device over the neck of the recovery container;

(d) inverting the salvage container; and (e) inserting the neck of the salvage container into the opening of the top surface of the device, wherein fluid drains from the neck opening of the salvage container into the neck opening of the recovery container.

* * * * *